United States Patent [19]

Fahlën

[11] Patent Number: 4,897,894

[45] Date of Patent: Feb. 6, 1990

[54] VACUUM CLEANER NOZZLE

[75] Inventor: Stefan M. Fahlën, Bromma, Sweden

[73] Assignee: Aktiebolaget Electrolux, Stockholm, Sweden

[21] Appl. No.: 97,670

[22] Filed: Sep. 17, 1987

[30] Foreign Application Priority Data

Oct. 3, 1986 [SE] Sweden ..... 8604218

[51] Int. Cl.[4] ..... A47L 9/02

[52] U.S. Cl. ..... 15/365; 15/367; 15/398; 15/416; 15/417

[58] Field of Search ..... 15/393, 394, 398, 401, 15/415 R, 416, 417, 422, 104 A, 365, 367

[56] References Cited

U.S. PATENT DOCUMENTS

| | | | |
|---|---|---|---|
| 1,907,370 | 5/1933 | Schoeller | 15/393 |
| 2,091,290 | 8/1937 | Replogle | 15/393 |
| 2,240,005 | 4/1941 | Moyer | 15/393 |
| 2,815,525 | 12/1957 | Lofgren | 15/417 |
| 3,108,311 | 10/1963 | House | 15/417 |
| 3,110,923 | 11/1963 | Berlene | 15/394 |
| 3,745,605 | 7/1973 | Zembold | 15/400 |
| 3,833,962 | 9/1974 | Krusche | 15/400 |

FOREIGN PATENT DOCUMENTS

| | | | |
|---|---|---|---|
| 0200698 | 11/1986 | European Pat. Off. | 15/417 |
| 3440736 | 8/1985 | Fed. Rep. of Germany | 15/417 |
| 7315595 | 5/1975 | Netherlands | 15/400 |
| 1116277 | 6/1968 | United Kingdom | 15/417 |
| 2014437 | 8/1979 | United Kingdom | 15/398 |

*Primary Examiner*—Harvey C. Hornsby
*Assistant Examiner*—K. O'Leary
*Attorney, Agent, or Firm*—Alfred F. Miller

[57] ABSTRACT

A vacuum cleaner nozzle comprises a body (10) having a suction passageway (11) extending therethrough, both ends of said passageway being adapted to receive a suction conduit (20). One end of the suction passageway is surrounded by a dust-brush (12) and two rotatable wing members (13) are provided at the other end. Each of the wing members comprises a resilient means (15) provided with a fiber picking material (16).

3 Claims, 2 Drawing Sheets

VACUUM CLEANER NOZZLE

The present invention relates to a nozzle for a vacuum cleaner, comprising a nozzle body having a suction passageway extending therethrough, both ends of said passageway being adapted to receive a suction conduit, one end of said passageway being surrounded by a dust-brush and two rotatable wing members being provided at the other end.

The wing members are rotatable about 90° between a position in which they are in a line and which is used for cleaning flat surfaces, and a position in which they are generally mutually parallel. They can also be adjusted to take any desired intermediate position for cleaning curved surfaces, such as upholstered furniture. A nozzle of this kind is described in U.S. Pat. No. 2,815,525. As is described in this patent, the suction conduit is inserted between the wing members which are in the mutually parallel position, when the dust-brush is to be used. In this position, the wing members extend alongside the suction conduit and are therefore no obstacle during the cleaning operation.

When the nozzle is to be used for cleaning textiles with the wing members engaging the surface to be cleaned, it is preferable to provide the working surface of the nozzle with a fibre picking material in order to remove animal hair and the like. With the known nozzle, however, this has not appeared to be possible since the above-mentioned insertion of the suction conduit between the wing members would be prevented by this material.

The object of the invention is to provide a vacuum cleaner nozzle in which the above-mentioned problem of picking up fibres has been eliminated. This has been achieved by means of a nozzle of the kind mentioned in the introduction which according to the invention is characterized in that each of the wing members comprises a resilient means provided with a fibre picking material.

Figure 1:
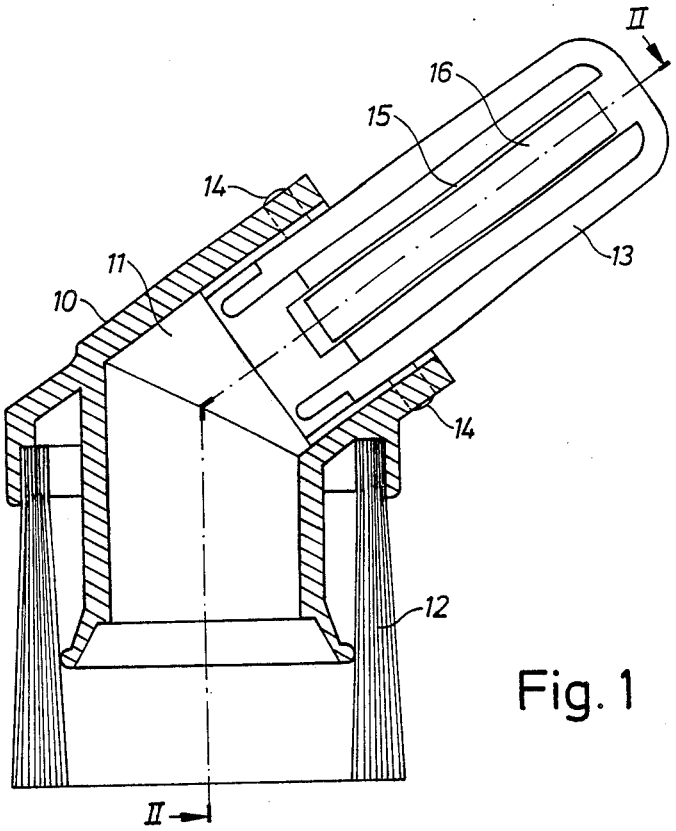
Figure 3:
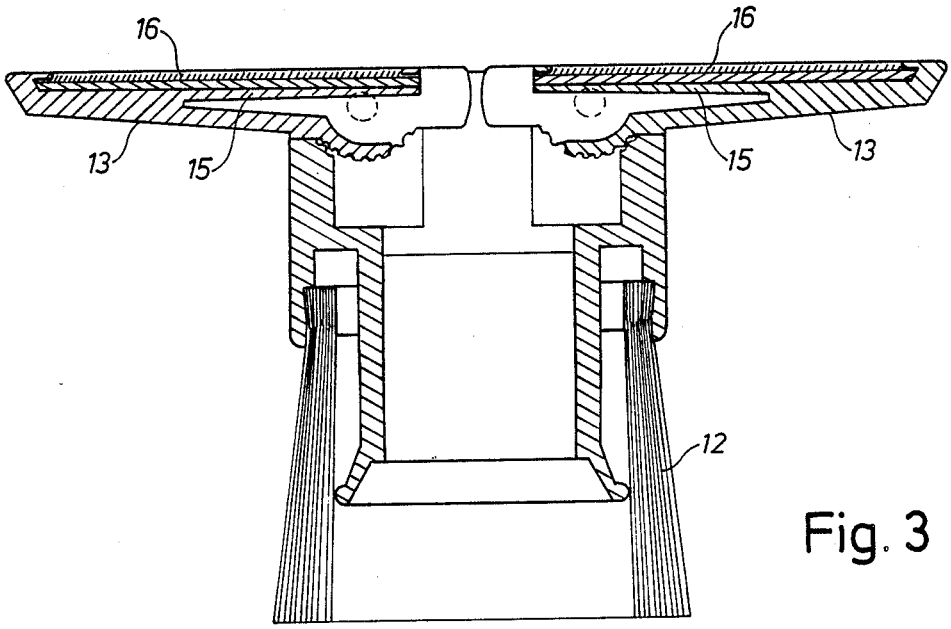
Figure 2:
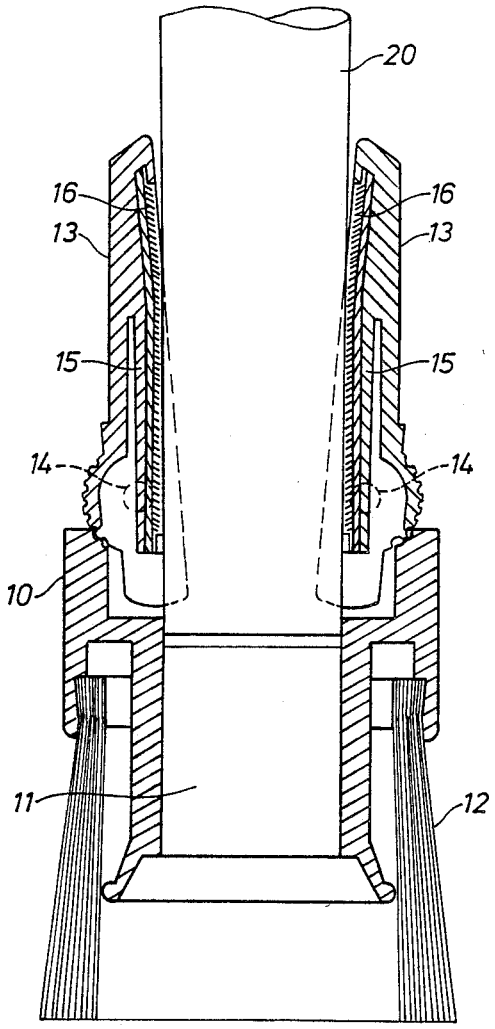

The invention will be described in more detail below with reference to the accompanying drawings, on which FIG. 1 is a longitudinal section of the nozzle according to the invention, FIG. 2 is a section taken along the line II—II in FIG. 1, and FIG. 3 is a view corresponding to FIG. 2 but with the nozzle in another position.

The vacuum cleaner nozzle shown in the drawings comprises a nozzle body 10 with a suction passageway 11 extending therethrough, both ends of said passageway being shaped to be optionally connected to a suction conduit which is in its turn connected to a vacuum cleaner. Such a conduit 20 is shown in FIG. 2. One end of the passageway 11 is surrounded by a circular dust-brush 12, and two wing members 13 are provided at the other end, said wing members being rotatably mounted on the nozzle body 10 by means of pivot pins 14.

Each of the wing members 13 comprises an integral spring means 15 which on its front side is provided with a strip 16 of a fibre picking material, such as plush. The strip 16 is preferably attached by glueing to the spring means 15 which in turn is connected to the rest of the wing member at the outer, free end thereof. In FIG. 3, the wing members 13 are shown in the expanded working position which is taken for the cleaning of e.g. upholstered furniture with the suction conduit connected to the opposite end, and the strip 16 serving to remove animal hair and the like from the surface to be cleaned.

FIG. 2 illustrates the position of the nozzle when the dust-brush 12 is used for suction cleaning of hard furniture or the like. As compared to FIG. 3 the wing members 13 are here rotated about 90° to a position in which they are generally parallel, and the suction conduit 20 is inserted in the space therebetween with the wing members extending along the suction conduit on both sides thereof. Owing to the resilient of the spring means 15, the suction conduit can be easily inserted into the shown position without impediment and without damaging the fibre picking strips 16.

Thus, the fibre picking strips 16 contain the fibers and other textile materials that are drawn into the strips by the vacuum present in the suction conduit 20. Moreover, the plush fibre picking strips 16 inherently retain the fibers after they are drawn into the strips by the vacuum, and manually cleaning is required in order to dislodge the fibers from the strips 16.

I claim:

1. A nozzle for a vacuum cleaner being adapted to receive a suction conduit comprising a nozzle body provided with a suction passageway extending therethrough, both ends of said passageway being capable of alternately having attached thereto said suction conduit, a dust brush secured to and surrounding one end of said passageway, a pair of wing members each having outer and inner ends and being pivotally mounted at its inner end on the opposite end of said passageway and rotatable in opposite directions, each of said wing members having a resilient element mounted medially on the respective wing member and extending toward the inner end thereof, said resilient element having secured thereto a plush fiber picking material for cleaning textile materials said resilient element permitting the insertion of the suction conduit in said passageway to prevent damage to the plush picking material.

2. A nozzle as claimed in claim 1 wherein each of said resilient elements is a spring that is integral with the adjacent wing member.

3. A nozzle as claimed in claim 2 wherein said spring is forced outwardly a limited amount when said wing members are rotatable to a position substantially parallel to the axis of said suction conduit when the latter is inserted between said wing members.

* * * * *